US006178930B1

(12) United States Patent
Triberti

(10) Patent No.: US 6,178,930 B1
(45) Date of Patent: Jan. 30, 2001

(54) SAFETY CAP, PARTICULARLY FOR COOLING LIQUID CIRCUITS OF I.C. ENGINES FOR MOTORVEHICLES

(75) Inventor: Franco Triberti, Grugliasco (IT)

(73) Assignee: Behr Thermot-Tronik Italia S.p.A., Turin (IT)

( * ) Notice: Under 35 U.S.C. 154(b), the term of this patent shall be extended for 0 days.

(21) Appl. No.: 09/425,166

(22) Filed: Oct. 22, 1999

(30) Foreign Application Priority Data

Oct. 23, 1998 (EP) ..... 98830641

(51) Int. Cl.[7] ..... F01P 11/16

(52) U.S. Cl. ..... 123/41.15; 220/DIG. 32; 220/254

(58) Field of Search ..... 123/41.01, 41.15, 123/41.54; 220/203.06, 203.26, DIG. 32, 254, 256

(56) References Cited

U.S. PATENT DOCUMENTS 4,927,049 * 5/1990 Giordano ..... 220/201
5,195,646 * 3/1993 Robinson ..... 220/256
5,741,069 * 4/1998 Egel ..... 374/146

FOREIGN PATENT DOCUMENTS 1600373 1/1968 (FR) .
WO97 48616 12/1997 (WO) .
WO98 00347 1/1998 (WO) .

* cited by examiner

*Primary Examiner*—Andrew M. Dolinar
*Assistant Examiner*—Hai Huynh
(74) *Attorney, Agent, or Firm*—Sughrue, Mion, Zinn, Macpeak & Seas, PLLC

(57) ABSTRACT

A safety cap, particularly for cooling liquid circuits of i.c. engines for motorvehicles, comprising an inner cover to be screwed onto a circuit filler and bearing a body axially and sealingly engageable within the filler. The body is hollow and carries a thermostatic actuator, and the inner cover is substantially completely surrounded by an outer cover which is movable, by means of the thermostatic actuator, from a torsionally coupled position to a torsionally uncoupled position relative to the inner cover.

8 Claims, 4 Drawing Sheets

SAFETY CAP, PARTICULARLY FOR COOLING LIQUID CIRCUITS OF I.C. ENGINES FOR MOTORVEHICLES

BACKGROUND OF THE INVENTION

The present invention is related to caps for containers of liquid under pressure or at high temperature, and more particularly for tanks or radiators of cooling liquid circuits of i.c. engines for motorvehicles.

These caps normally comprise a cover of a generally circular shape having an inner thread engageable onto an outerly threaded filler and bearing a body adapted to axially fit within said filler.

SUMMARY OF THE INVENTION

The object of the present invention is to provide a cap of the above-referenced type designed to afford a safety function consisting of preventing opening by the user in case the liquid temperature of the circuit to which the cap is applied be above a predetermined threshold value, and then enabling again opening thereof as soon as the liquid temperature lowers below said predetermined value.

A further object of the invention is to provide a cap with the above safety function which is however capable to allow, following a procedure not immediately within the user's skillness, opening thereof even if the liquid temperature has raised above said predetermined value, for instance owing to emergency reasons.

According to the invention these objects are achieved by a safety cap of the above-referenced type the primary feature of which resides in that it includes a thermostatic actuator carried by said body and a second cover substantially completely surrounding said cover and movable, by means of said thermostatic actuator, from a torsionally coupled position to a torsionally uncoupled position relative to said cover, and further comprising releasable connecting means between said second cover and said stem of said thermostatic actuator.

According to a preferred embodiment of the invention said body of the cap is hollow and the thermostatic actuator incorporated within the hollow body and includes a housing containing a heat expandable material having a high thermal expansion coefficient and a stem projecting from the housing and axially connected to said second cover, the stem being axially displaceable with respect to the housing, following expansion of said heat expandable material, from a retracted condition corresponding to said torsionally coupled position, to an extracted condition corresponding to said torsionally uncoupled position of said second cover relative to said cover; resilient means being provided to urge said stem towards said retracted position.

The releasable connecting means are not immediately disengageable and can be either of a destructive type or, more conveniently, may comprise an open resilient stop disk engaged over an annular groove of said stem and slidably fitted within an outer elongated seat of said second cover, reference means being provided to angularly position said second cover and said stop disk relative to each other so as to enable sliding and withdrawal of said stop disk along said elongated seat.

BRIEF DESCRIPTION OF THE DRAWINGS

Additional features and advantages of the invention will become apparent in the following detailed description, with reference to the accompanying drawings purely provided by way of non limiting example, in which.

DETAILED DESCRIPTION OF THE INVENTION

Figures 1, 2:
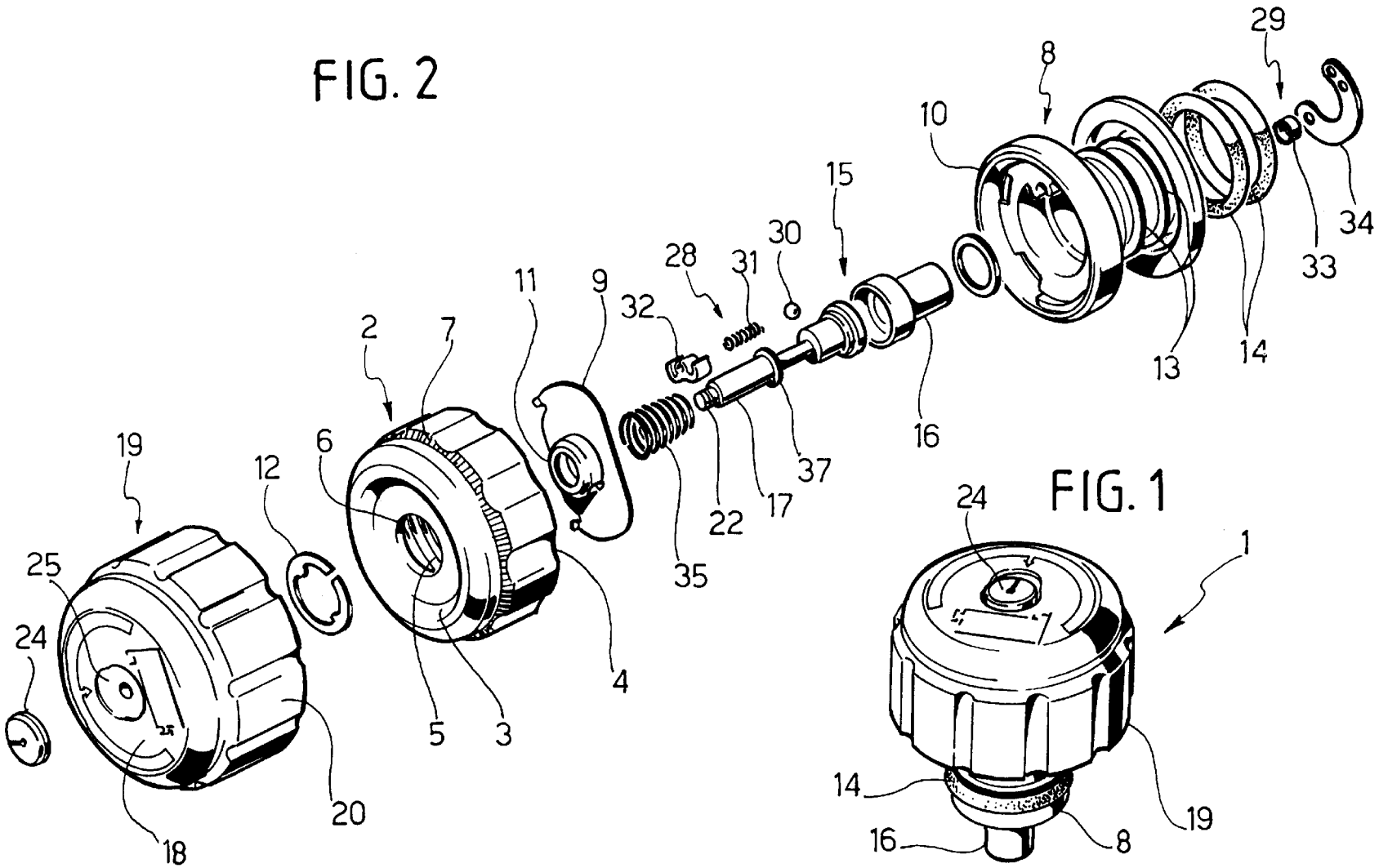
FIG. 1 is a diagrammatic perspective view showing a safety cap according to the invention as a whole.
FIG. 2 is an exploded view of FIG. 1.
Figure 3:
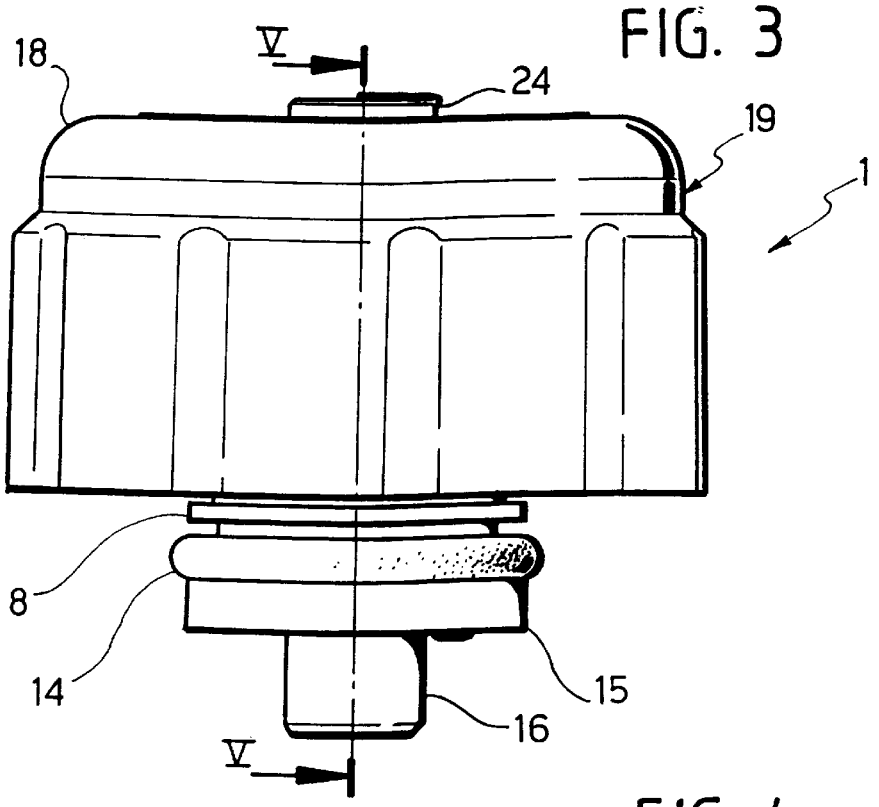
FIG. 3 is a lateral elevational and enlarged view of the safety cap.
Figure 4:
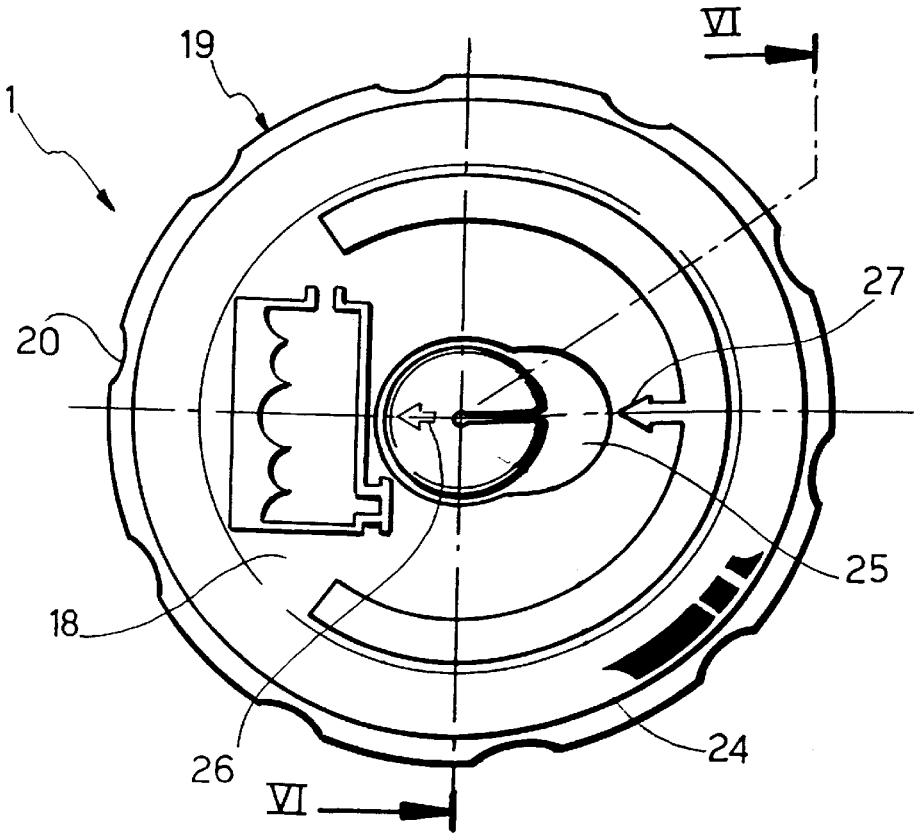
FIG. 4 is top plan view of FIG. 3.

Referring to the drawings, reference numeral 1 generally designates a safety cap particularly intended to be applied to the tank of the cooling liquid circuit of an internal combustion engine for motorvehicles. This tank, not shown in the drawings since of a conventional type, includes an outerly threaded filler relative to which the safety cap 1 can be screwed and unscrewed such as clarified in the following.

The safety cap 1 comprises a first or inner cover 2 having a generally circular cup-like design with an upper base wall 3 and a cylindrical lateral wall 4 having an inner thread 5 adapted to engage the outer thread of the filler of the circuit tank.

The upper base 3 has a central through hole 6, and in proximity of the connecting area between the base wall 3 and the lateral wall 4 the inner cover 2 is formed with an annular crown of outer indentations 7.

Reference numeral 8 designates a tubular axial body arranged within the inner cover 2 and projecting below the lateral wall 4 thereof. The tubular body 8 is rotatably connected to the upper base wall 3 of the cover 2 by means of a transverse element 9 fitted within an enlarged end portion 10 of the body 8 and centrally provided with an annular collar 11 which is fitted through the central hole 6 of the base wall 3 and is connected to the latter by means of a resilient stop ring 12.

The body 8 is further formed with a pair of outer annular seats 13 housing respective rubber seal rings 14 designed to provide a double radial watertight contact against the inner wall of the tank of the circuit filler when the body 8 is fitted therewithin. The upper seal ring 14 is subjected to a resilient pre-load slightly greater than that of the lower seal ring 14 so as to perform in use, while the cap 1 is removed, a progressive discharge of any pressure from the filler. This effect may be simply achieved providing the two seals 14 with slightly different diameters.

According to a variant of the invention not shown in the drawings the water tight closure of the tank filler can be provided, instead of radially by means of the ring seals 14, axially through an annular gasket applied on the inner face of the base wall 3 of the inner cover 2 and designed to close frontally the filler.

According to the invention, a thermostatic actuator 15 is fitted within the cavity of the body 8 and includes, in a way generally known per se, a housing 16 containing an expandable material having a high thermal expansion coefficient, for instance wax, and an axial stem 17. The housing 16 is carried by the end 8*a* of the body 8 opposite to the enlarged portion 10 and projects therebeneath, so as to be exposed—in use—to the temperature of the circuit liquid. The stem 17 axially passes through the collar 11 of the transverse element 9 and the upper base wall 18 of a second or outer cover 19 which substantially completely surrounds the cover 2. The outer cover 19 has also a cylindrical lateral wall 20, having an axial length greater than that of the lateral wall 4 of the inner cover 2, and is formed, in proximity of the connecting area between the base wall 18 and the lateral wall 20, with an inner annular crown of indentations 21 complementary to the indentations 7 of the inner cover 2.

The free end of the stem 17, indicated as 22, projects above the base wall 18 of the outer cover 19 and has an annular grove 23 over which a resilient open stop disk 24 is fitted. The stop disk 24 is slidably housed within an outer elongated seat 25 of the base wall 18 of the outer cover 19, for the reasons and in the way which shall be clarified in the following. Moreover the stop disk 24 is provided with a visual reference 26 designed to be angularly positioned, for the reasons and in the way which shall also be clarified in the following, in correspondence of a visual reference 27 provided on the base wall 18 of the outer cover 19.

Sealing gaskets not shown in the drawings ensure a perfect watertightness in the area of the end 22 of the stem 17 and of the related groove 23 with the stop disk 24.

An adjustable relief valve 28 and a pressure reinstatement valve 29 are further provided inside the body 8, and their function is to connect the circuit to which the safety cap 1 is applied to the atmosphere, at the circuit outlet and inlet, respectively.

The relief valve 28 includes a ball obturator 30 subjected to the action of a helical spring 31 whose load is adjustable by means of an insert 32 having a selectable thickness.

The pressure reinstatement valve 29 comprises an obturator block 33 subjected to the action of an arcuated plate spring 34.

Figure 5:
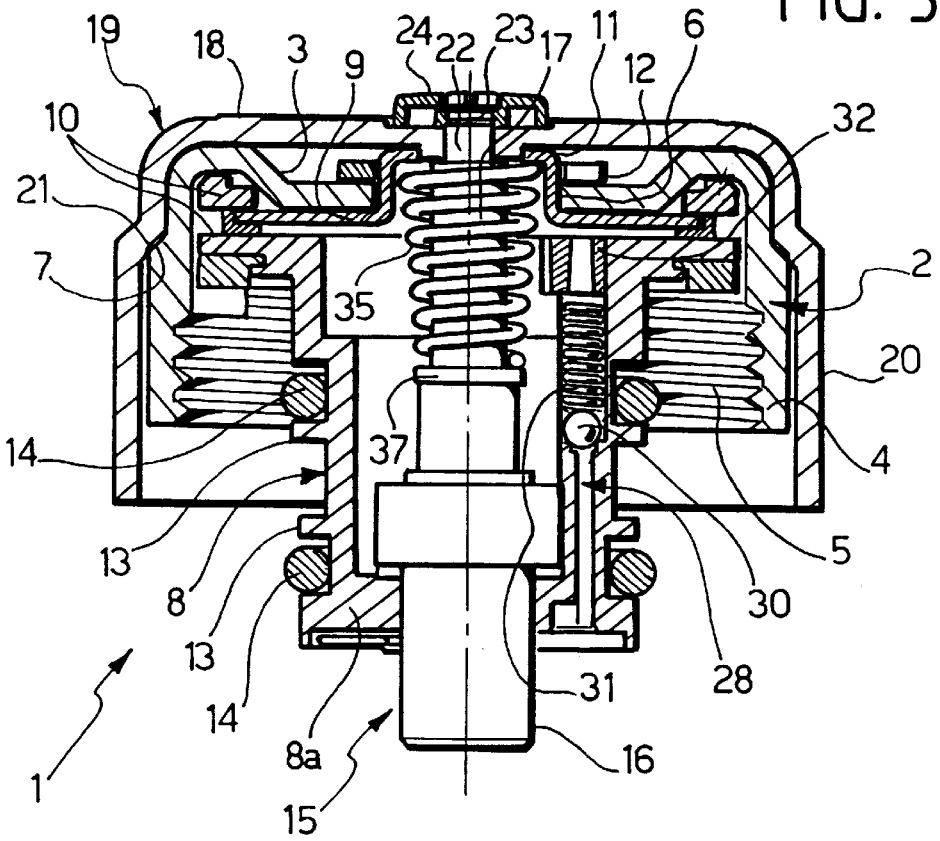
FIG. 5 is an axially sectioned view along line V—V of FIG. 3.
Figure 6:
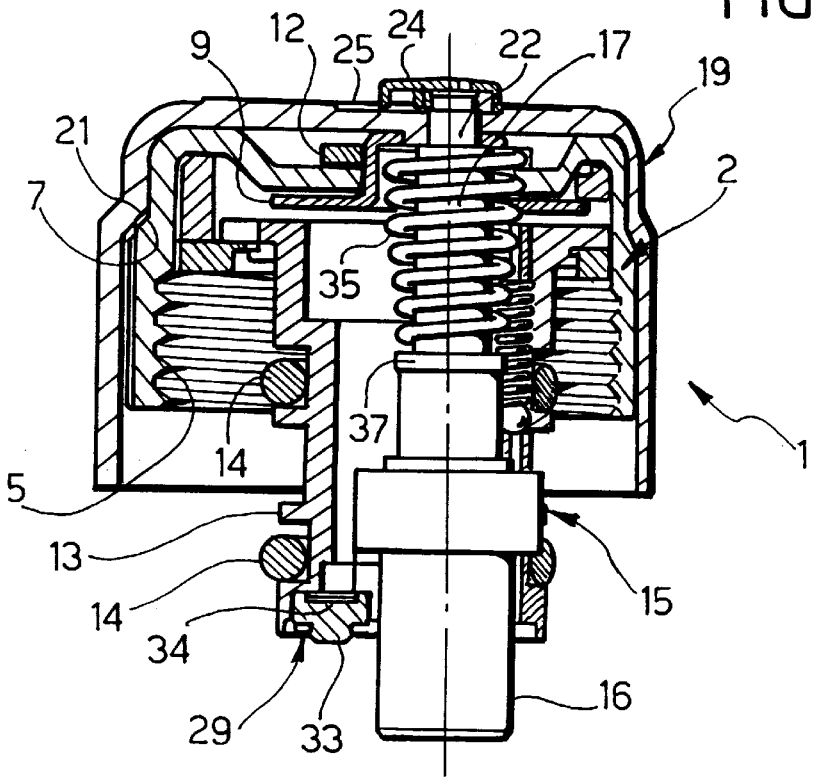
FIG. 6 is an axially sectioned view along line VI—VI of FIG. 4.

Reference numeral 35 lastly designates a compression helical spring interposed between the collar 11 of the transverse element 9 and an annular abutment 36 of the stem 17 and urging the latter towards the retracted position relative to the housing 16, depicted in detail in FIGS. 5 and 6. In this position the crown of outer indentations 7 of the inner cover 2 and the crown of inner indentations 21 of the outer cover 19 are mutually engaged with each other, whereby the covers 2 and 19 are torsionally secured to each other. This condition is maintained as long as the temperature at which the housing 16 of the thermostatic actuator 15 is exposed, is below a predetermined threshold value. In that condition the cap 1 can be screwed and unscrewed relative to the circuit filler without any difficulty.

Figure 7:
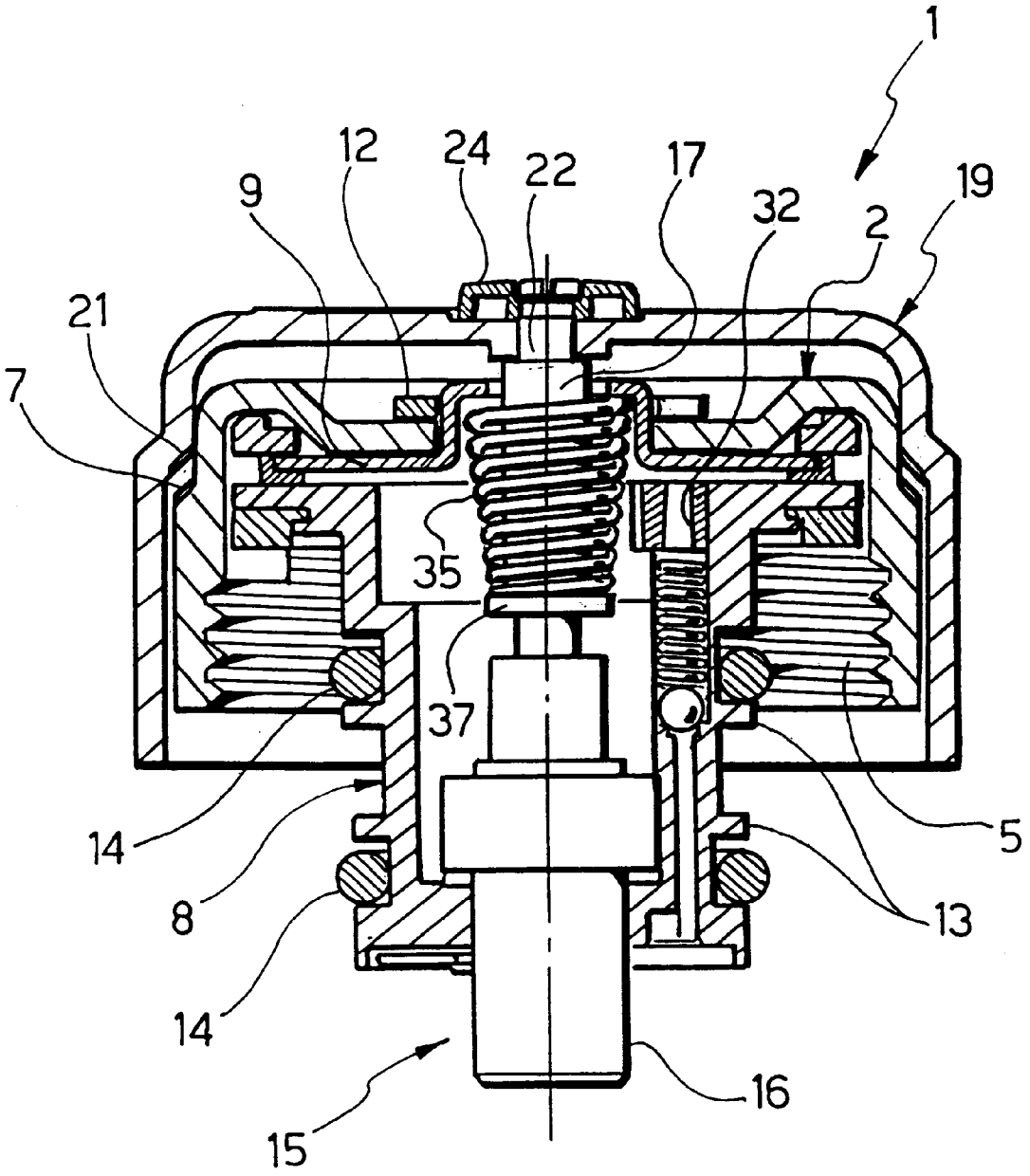
FIG. 7 is a view same as FIG. 5 showing operation of the cap.

Whenever the temperature of the circuit liquid exceeds that predetermined threshold value (for instance, in the case of the cooling liquid of an internal combustion engine, a temperature of about 80° C.) expansion of the expandable material within the housing 16 of the thermostatic actuator 15 produces axial extraction of the stem 17 towards the position shown in FIG. 7, against the action of the spring 35. Owing to this extraction the outer cover 19 is raised relative to the inner cover 2, whereby the crown of the indentations 21 is disengaged from the crown of indentations 7 and the outer cover 20 is thus torsionally released from the inner cover 2, i.e. is made freely rotatable. In such event the cap 1 cannot be unscrewed and removed from the filler in an immediate and direct way. Removal, whenever strictly necessary, requires disassembling the outer cover 19, so as to make the inner cover 2 accessible from the outside. In the case of the shown embodiment this can be carried out by removing the stop disk 24 from the grove 23 of the end 22 of the stem 17, and such a removal can be performed only in one pre-set mutual angular position between the stop disk 24 and the outer cover 19, in correspondence of which the stop disk 24 can be slided along the elongated seat 25 so as to disengage from the grove 23. This mutual angular position corresponding to alignment between the visual references 26 and 27, which must thus have to be precisely collimated. This operation is evidently not within the immediate skill of the user, thus safeguarding in any case the safety effect provided by the cap according to the invention.

Naturally the details of construction and the embodiments may be widely varied with respect to what has been disclosed and illustrated, without thereby departing from the present invention such as defined in the appended claims. Thus, for example, it is clear that the torsional coupling system in the contracted condition of the thermostatic actuator 15 between the inner cover 2 and the outer cover 19 may be carried out by means of different expedients than the indentations 7 and 21. Moreover the release system of the outer cover 19 relative to the inner cover 2 may also be different than that disclosed with reference to the example, and may comprise any releasable connecting system even of a destructive type.

What is claimed is:

1. A safety cap, particularly for cooling liquid circuit of an internal combustion engine for motorvehicles including an outerly threaded filler, said cap comprising a first cover of a generally circular shape having an inner thread engageable onto said outerly threaded filler and bearing a body adapted to axially fit within said filler, further comprising a thermostatic actuator carried by said body and a second cover substantially completely surrounding said first cover and movable, by means of said thermostatic actuator, from a torsionally coupled position to a torsionally uncoupled position relative to said first cover, and further comprising releasable connecting means between said second cover and a stem of said thermostatic actuator.

2. Safety cap according to claim 1, wherein said body is hollow and said thermostatic actuator is incorporated within said hollow body and includes a housing containing an expandable material having a high thermal expansion coefficient and said stem projecting from the housing and axially connected to said second cover, said stem being axially displaceable with respect to said housing, following expansion of said expandable material, from a retracted condition corresponding to said torsionally coupled position, to an extracted condition corresponding to said torsionally uncoupled position of said second cover relative to said cover; resilient means being provided to urge said stem towards said retracted condition.

3. Safety cap according to claim 2, wherein said housing projects outside of said hollow body.

4. Safety cap according to claim 1, wherein said releasable connecting means include an open resilient stop disk engaged over an annular grove of said stem and slidably fitted within an outer elongated seat of said second cover, reference means being provided to angular position said second cover and said stop disk relative to each other so as to enable sliding and withdrawal of said stop disk along said elongated seat.

5. Safety cap according to claim 1, further comprising adjustable relief valve means arranged within said body.

6. Safety cap according to claim 1, further comprising pressure reinstatement valve means arranged within said body.

7. Safety cap according to claim 1 wherein said body is provided with a pair of outer annular seals designed to perform dual radial watertightness with said filler under a differential resilient load.

8. Safety cap according to claim 1 wherein in that said first cover is provided with an inner front seal designed to perform axial watertightness with said filler.

* * * * *